US007441762B2

(12) United States Patent
Kearns

(10) Patent No.: US 7,441,762 B2
(45) Date of Patent: Oct. 28, 2008

(54) SPECIAL ORDER BOOK PRODUCTION SYSTEM

(75) Inventor: Ryan Kearns, Dublin, CA (US)

(73) Assignee: CafePress.com, San Leandro, CA (US)

( * ) Notice: Subject to any disclaimer, the term of this patent is extended or adjusted under 35 U.S.C. 154(b) by 675 days.

(21) Appl. No.: 11/082,129

(22) Filed: Mar. 15, 2005

(65) Prior Publication Data

US 2006/0210379 A1 Sep. 21, 2006

(51) Int. Cl.
*B65H 37/04* (2006.01)

(52) U.S. Cl. ..... 270/52.02; 270/1.01; 270/52.03; 270/58.07; 270/58.08

(58) Field of Classification Search ..... 270/1.01, 270/52.02, 52.03, 58.07, 58.08; 412/1, 4, 412/13, 14, 17, 18, 19, 33
See application file for complete search history.

(56) References Cited

U.S. PATENT DOCUMENTS

| | | | | |
|---|---|---|---|---|
| 3,899,165 | A | 8/1975 | Abram et al. | |
| 5,465,213 | A * | 11/1995 | Ross | 700/117 |
| 5,838,574 | A * | 11/1998 | Olson et al. | 700/219 |
| 6,206,358 | B1 * | 3/2001 | Yamaguchi et al. | 270/52.02 |
| 7,236,934 | B1 * | 6/2007 | Mayes | 705/1 |
| 2003/0093382 | A1 * | 5/2003 | Himeno et al. | 705/51 |
| 2005/0157315 | A1 * | 7/2005 | Kato | 358/1.1 |
| 2006/0028662 | A1 * | 2/2006 | Dobrovolsky | 358/1.9 |

FOREIGN PATENT DOCUMENTS

JP 03151292 A * 6/1991

* cited by examiner

*Primary Examiner*—Gene O. Crawford
*Assistant Examiner*—Leslie Nicholson, III
(74) *Attorney, Agent, or Firm*—David H. Jaffer; Pillsbury Winthrop Shaw Pittman LLP

(57) ABSTRACT

A method of book production wherein a customer sends a computer file of a book to a producer whose computer book production program restructures the text and cover data to fit a standard/preferred size accommodated by the producer's book binding system. The program then calculates the spine dimensions, and this is sent to the customer for determining a layout and content for printing on the spine. The layout is sent to the producer who inserts it into the book production program with a job identification spine code. The producer inserts a code in the cover data identifying the corresponding text and spine. At the beginning of each day/production run, the producer simply enters the covers in the desired order into the production program. The program reads the cover code, which identifies the corresponding stack and spine and directs the printing and binding accordingly.

8 Claims, 3 Drawing Sheets

SPECIAL ORDER BOOK PRODUCTION SYSTEM

BACKGROUND OF THE INVENTION

1. Field of the Invention

The present invention relates generally to book production, and more particularly to a method and system for efficient production of book orders of any quantity.

2. Description of the Prior Art

The production of books in small quantities is an expensive process, involving manual operations. Generally, for a particular order the system is shut down and the binding equipment is adjusted for the particular order. Due to the set-up costs for each order, there is an emphasis on large quantity orders, making the production of only a few books impractical. U.S. Pat. No. 3,899,165 by Abrams et al. describes a means for adjusting a binding system to accommodate a variable book thickness. U.S. Pat. No. 6,206,358B1 describes use of separate sheets with information identifying a book cover and a book stack, and a system that reads the information and stops binding operation if the cover identification does not correspond to the stack information.

SUMMARY

Briefly, a preferred embodiment of the present invention includes a method of book production wherein a customer sends a computer file of a book to a producer whose computer book production program restructures the text and cover data to fit a standard/preferred size accommodated by the producer's book binding system. The program then calculates the spine dimensions, and this is sent to the customer for determining a layout and content for printing on the spine. The layout is sent to the producer who inserts it into the book production program with a job identification spine code. The producer inserts a code in the cover data identifying the corresponding text and spine. At the beginning of each day/production run, the producer simply enters the covers in the desired order into the production program. The program reads the cover code, which identifies the corresponding stack and spine and directs the printing and binding accordingly.

IN THE DRAWING

DETAILED DESCRIPTION OF THE PREFERRED EMBODIMENTS

Figure 1:
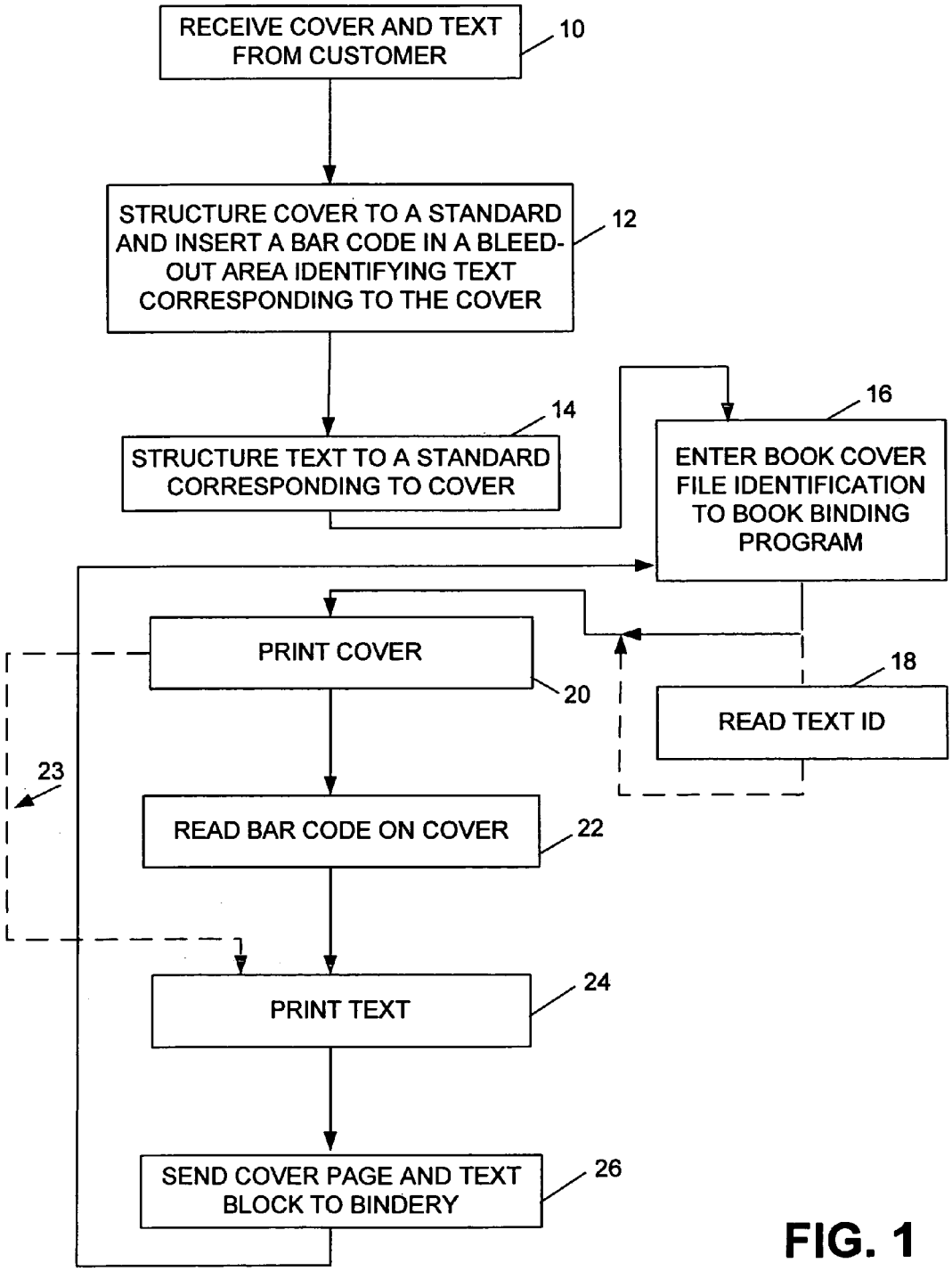
FIG. 1 is a flow chart of a method of the present invention.

The method and system of the present invention provides for economical production of small or large quantity book orders. The method avoids manual layout of text or graphics by the book producer and associated decisions and manual settings. FIG. 1 is a flow chart that illustrates the method of the present invention. The process/method begins with a customer sending a file to the book producer. The file contains the cover layout/data and text for a book (block 10). Having received the book file, the producer applies a book production computer program that re-structures the cover data to fit a cover size that is a standard/preferred size available for production by the producer. Similarly, the producer restructures the text to fit the producer's standard page. A code is placed in a bleed-out area of the cover page that identifies the corresponding text file, and a file containing a spine layout yet to be completed (blocks 12 and 14).

The producer then simply enters a book order into the book production computer by identifying/entering a book cover (block 16) and directs the printing of the cover (block 20). A bar code reader then reads the text code from the printed cover page (block 22), identifying the text, which is then printed (block 24). The text and cover pages are then sent to a bindery (block 26), and the computer returns to block 16 to retrieve the next cover, which can be one more of the same book, or another book. Referring again to block 16, after a book cover identification has been entered, the computer can read a text identification code in the data (block 18), and then print the cover (block 20). Since the computer has read the text code, it can skip the bar code step 22 as indicated by line 23 and then print the text 24.

Figure 2:
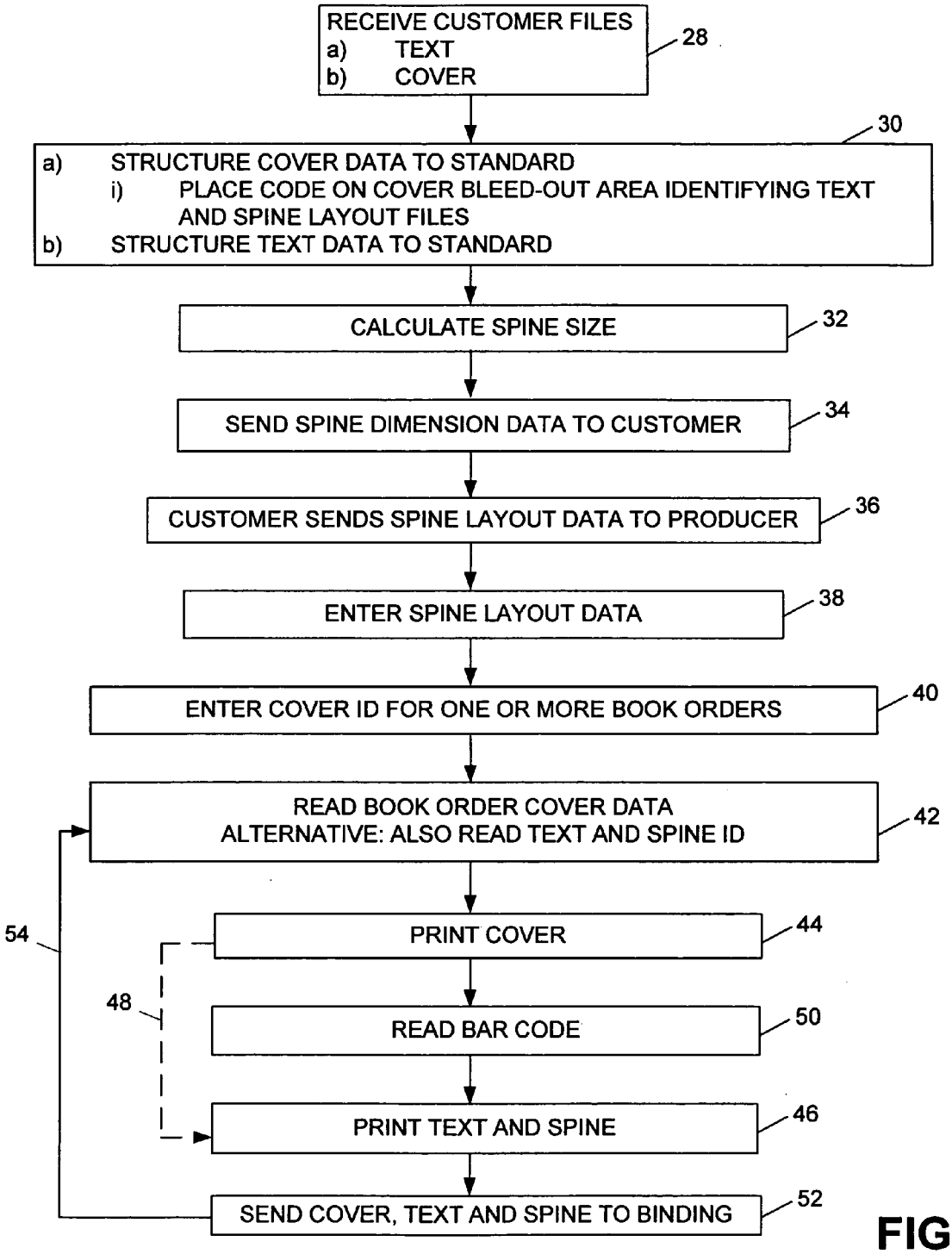
FIG. 2 is a flow chart of an alternate embodiment of the present invention.

FIG. 2 illustrates an alternate embodiment of the present invention that provides for input from a customer regarding printing on the book spine area. The producer receives book files, including a cover file and a text file from the customer (block 28), similar to block 10 of FIG. 1. The producer's computer then restructures the book cover and text to fit a standard cover and corresponding text pages (block 30). The computer places a code on the cover data indicating which text file applies, and the file location of the spine layout data. The text and spine code can be read directly from the data, or it can be configured to be placed as a bar code in a bleed-out area of the book cover, similar to block 12 of FIG. 1.

The producer's computer then calculates the spine size (block 32). The producer then sends the spine size data to the customer (block 34), who determines what is to be printed on the spine and the spine layout. The customer then sends the spine data to the producer (block 36). The producer enters the spine data into the book production computer (block 38). At the beginning of each day or production run, the producer enters cover identification for one or more book orders, with corresponding quantities (block 40).

The computer then reads a book order from the cover data entered, and alternatively a code identifying corresponding text and spine files (block 42). The cover page is then printed (block 44). If the text and spine were read previously, the bar code reading can be bypassed (line 48), and the text and spine items can be printed (block 46). As an alternate embodiment, the text and spine identification are not read directly. After the cover is printed (block 44), the bar code on the cover page is read (block 50), identifying the text and spine files. The text and spine are then printed (block 46). With the cover, text and spine printed, they are then sent to be bound (block 52), and another book is retrieved, which may be a different order than the prior book, or it may be another book of an order for multiple copies (line 54 and block 42).

It is an aspect of the present invention that each copy of a book is processed separately by the computer and sent in order to the bindery. In this way, there is no confusion in identifying a cover with a book or spine at the binder, and the entry of the multiple orders of different books is all handled by the computer, thus avoiding the need for manual or machine sorting of pages at the bindery.

Figure 3:
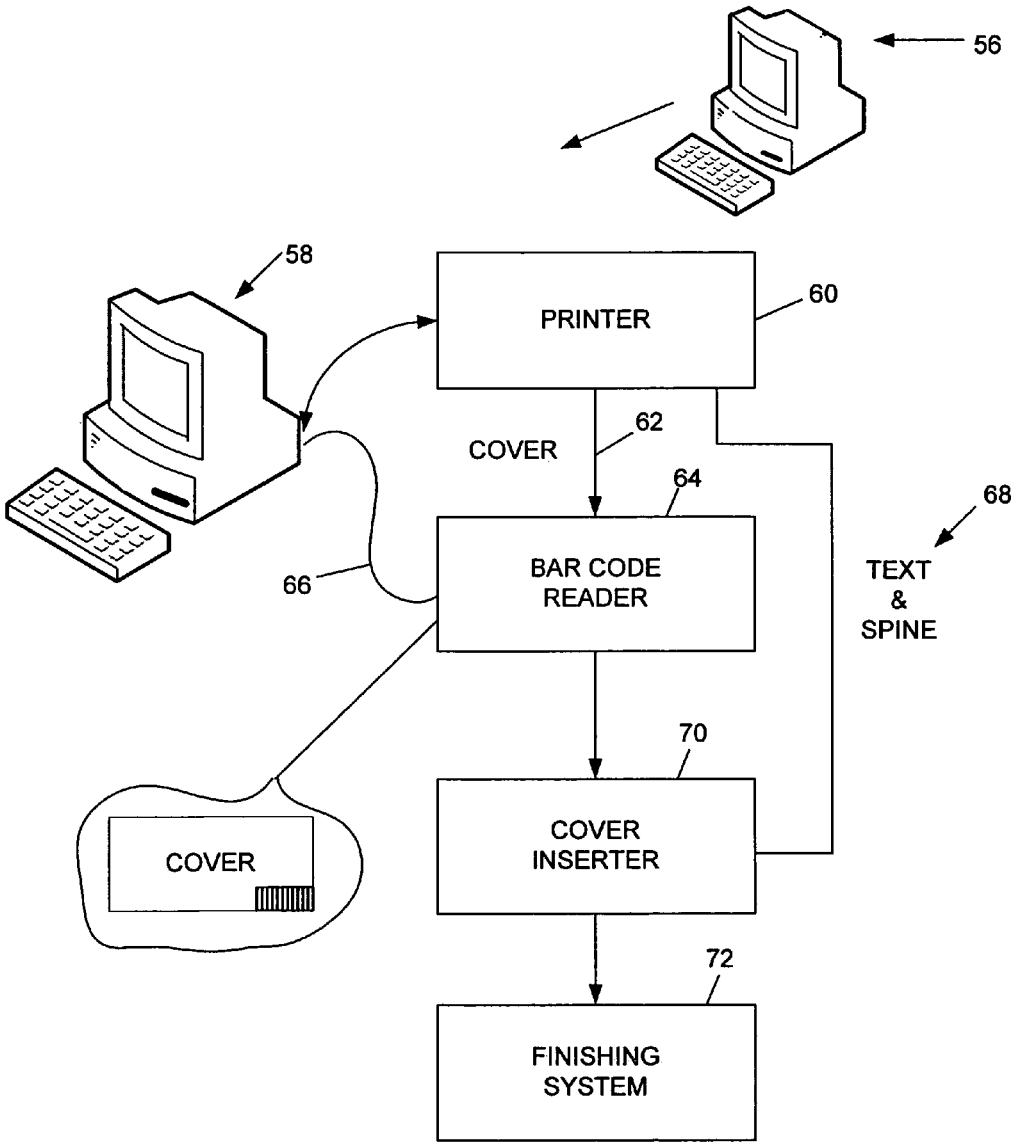
FIG. 3 is a schematic of a system of the present invention.

A system of the present invention is illustrated in FIG. 3. A customer prepares the cover, text and spine files on a customer computer 56. These files are sent by any of various means to a book producer, and input to the producer's computer 58. The computer 58 reconfigures/re-structures the cover and text files and calculates the dimensions of the spine, which are sent to the customer. The customer does a spine layout, and upon receipt and entry of the spine file from the customer, the producer inputs/directs the computer 58 to cause printer 60 to print a cover page 62. A bar code reader 64 reads the bar code in the printed cover bleed out area, and this is sent 66 to the computer 58, upon which the computer directs printer 60 to print the text and spine 68.

A cover inserter 70 inserts the cover and spine and the book is bound 72. Upon sensing the completion of the printing by printer 60, the computer 58 begins the same process for the next book according to the order of production entered. The next book in line, which can be a duplicate of the first, as in orders for multiple copies, or it can be a different book.

The invention claimed is:

1. A book production method comprising:

(a) receiving by a book producer a plurality of book cover data files and corresponding book text data files from a corresponding plurality of customers;

(b) reformatting by said producer each said book text data file and each said book cover data file to fit a preferred book size for production of a book from each book cover data file and its corresponding book text data file by said producer;

(c) adding by said producer a code to each book cover data file, wherein each said code includes identification of its corresponding book text data file;

(d) directing with a computer the production of a plurality of books from the book cover data files and the book text data files by:

(i) printing a book cover for one of the plurality of books using its book cover data file, reading said code from said book cover data file to identify said corresponding book text data file, and printing the book text pages using the corresponding book text data file;

(ii) binding said cover and said text pages; and (iii) repeating steps (i)-(ii) until said plurality of books is processed.

2. A method as recited in claim 1 wherein said code is printed as a bar code in a bleed out area on each cover.

3. A method as recited in claim 2 further including reading said bar code on said cover page to identify said corresponding book text data file.

4. A method as recited in claim 1 further comprising spine calculating by said computer after said reformatting, wherein said calculating determines dimensions of a spine area for each said book.

5. A method as recited in claim 4 wherein said code further includes identification of a spine file.

6. A method as recited in claim 5 further comprising sending each spine dimensions to a corresponding customer to allow said customer to prepare a spine file containing a spine layout.

7. A method as recited in claim 6 further comprising receiving a spine file from said customer and entering said spine file into said computer.

8. A method as recited in claim 7 further comprising printing a spine.

* * * * *